US005735136A

United States Patent [19]

Howe et al.

[11] Patent Number: 5,735,136

[45] Date of Patent: Apr. 7, 1998

[54] FLAKE FREEZING MACHINE AND SYSTEM USING SAME

[75] Inventors: Richard W. Howe, Mt. Prospect; Avinash K. Ahuja, Arlington Heights, both of Ill.

[73] Assignee: Howe Corporation, Chicago, Ill.

[21] Appl. No.: 526,291

[22] Filed: Sep. 11, 1995

[51] Int. Cl.[6] ..... F25C 1/14

[52] U.S. Cl. ..... 62/354; 165/169

[58] Field of Search ..... 62/354; 165/169

[56] References Cited

U.S. PATENT DOCUMENTS

| | | | |
|---|---|---|---|
| 2,712,734 | 7/1955 | Lees . | |
| 2,716,869 | 9/1955 | Lees . | |
| 2,758,451 | 8/1956 | Lauterbach . | |
| 2,910,841 | 11/1959 | Branchflower . | |
| 2,961,842 | 11/1960 | Wright . | |
| 3,011,323 | 12/1961 | Jaeger | 165/169 |
| 3,283,524 | 11/1966 | Byron . | |
| 3,403,532 | 10/1968 | Knowles . | |
| 3,494,144 | 2/1970 | Schill . | |
| 3,901,269 | 8/1975 | Henderson | 165/169 |
| 4,497,184 | 2/1985 | Utter et al. | 62/354 |
| 4,678,104 | 7/1987 | Pritchett | 165/169 |
| 4,850,202 | 7/1989 | Kito et al. | 62/354 |
| 4,991,407 | 2/1991 | Alvarez et al. | 62/354 |
| 5,158,755 | 10/1992 | Higgins et al. | 165/169 |
| 5,431,027 | 7/1995 | Carpenter | 62/354 |
| 5,448,894 | 9/1995 | Niblock et al. | 62/71 |
| 5,460,014 | 10/1995 | Wang | 62/354 |

FOREIGN PATENT DOCUMENTS

| | | |
|---|---|---|
| 613103 | 11/1926 | France . |
| 1085820 | 2/1954 | France . |
| 2047587 | 12/1980 | United Kingdom . |
| 2153387 | 8/1985 | United Kingdom . |

OTHER PUBLICATIONS

"Scotsman Rapid Freeze Industrial Ice Flakes" Brochure dated Jan. 1993.

International Search Report of Application No. PCT/US/96/14605, dated Dec. 20, 1996.

Database WPI, Section Ch, Week 9432, Derwent Publications Ltd., London, GB.

*Primary Examiner*—William E. Tapolcai

*Attorney, Agent, or Firm*—Daniel J. Hulseberg; Mayer, Brown & Platt

[57] ABSTRACT

Flake freezing machine includes an evaporator for producing frozen flakes using a freezable liquid from a liquid source. The evaporator includes a cast aluminum cylindrical structure having an inner surface defining an interior chamber and an outer surface. A stainless steel helical tubing assembly having an inlet and an outlet is embedded inside the cylindrical structure between the inner surface and the outer surface. Refrigerating fluid is circulated through the tubing assembly to cool the inner surface to a temperature sufficient to freeze the liquid. Positioned inside the interior chamber is a rotatable shaft, which supports a liquid distribution pan having radially extending nozzles for distributing the liquid onto the inner surface of the cylindrical structure so as to freeze as a frozen sheet and a blade member for removing the frozen sheet from the inner surface of the cylindrical structure in the form of frozen flakes. A flake freezing system is also provided, which includes the flake freezing machine, as well as an accumulator, a compressor, a condenser, and a heat exchanger. Operation of the flake freezing system is controlled automatically by a controller.

20 Claims, 7 Drawing Sheets

FLAKE FREEZING MACHINE AND SYSTEM USING SAME

BACKGROUND OF THE INVENTION

1. Field of the Invention

The present invention relates to a machine for freezing water or a similar freezable liquid in the form of flakes and a system using the same. Particularly, the present invention is directed to an evaporator that is relatively lightweight and inexpensive to manufacture for use in a flake freezing machine, as well as a flake freezing machine and system having the same incorporated therein.

2. Description of Related Art

Machines capable of freezing water or similar freezable liquids in the form of flakes are well known and have been available for a number of years. These flake freezing machines are widely used throughout food service businesses, including the meat, poultry and fishing industries for the storage, preservation and presentation of food products, as well as for commercial bakeries where the heat generated by large mixing apparatus can cook dough before intended. Flake freezing machines also may be used for producing the equivalent of food concentrates, such as for juices, beverages or other liquid food products. The use of ice flakes rather than water for the preparation dough keeps the dough cool, and thus prevents unintentional cooking. Similarly, ice flakes may be used for the preparation of concrete to prevent unintentional curing during the mixing process. In the medical field, ice flakes are used for treatment and patient care, while selected liquids such as medications, blood and glucose may be frozen in flake form for storage.

Generally, a conventional flake freezing machine includes an evaporator having a surface that is internally cooled by the flow of a refrigerant. Water or a similar freezable liquid is distributed onto the cooled surface so as to freeze as a frozen sheet. The frozen sheet is then removed in the form of flakes using a cutting blade.

U.S. Pat. No. 5,431,027 discloses one such embodiment of a flake freezing machine. In this embodiment, the evaporator is a hollow structure having an inner cylindrical side wall and an outer cylindrical side wall with an annular chamber defined therebetween. Refrigerant is introduced into the annular chamber through an inlet at the bottom of the evaporator, and then removed through an outlet located at the top of the evaporator. The refrigerant vaporizes within the annular chamber so as to cool the inner cylindrical side wall. Water is distributed and frozen onto the inner cylindrical side wall, and then removed in the form of ice flakes. In an attempt to create more uniform distribution of the refrigerant throughout the annular chamber, and thus, more uniform cooling of the inner cylindrical side wall, vertical partitions are spaced radially along the annular chamber.

An alternative known embodiment of a flake freezing machine likewise includes a cylindrical evaporator configuration. Rather than providing a hollow structure for the evaporator, however, this alternative embodiment includes an evaporator constructed of a series of steel hoop members. Each hoop member includes a ring-shaped horizonal leg and a downwardly-extending peripheral vertical leg. The hoop members are stacked and welded together on a central cylinder having an outer diameter equivalent to the inner diameter of the ring-shaped horizontal leg. In this manner, a corresponding series of toroidal chambers are formed between the stacked hoop members. The horizontal leg of each hoop member further includes a tongue portion that is bent downwardly into the toroidal chamber below. This creates a spiral ring-type labyrinth, which directs refrigerant in a circular pattern around the central cylinder. The circular flow of refrigerant uniformly cools the central cylindrical sufficiently to freeze water or similar freezable liquid thereon for the production of frozen flakes. However, it is evident that the labor intensive process required to manufacture this evaporator is both time consuming and costly. Although durable in construction, it is also evident that this flake freezing machine is extremely heavy, thus making it difficult and expensive to ship and move.

In view of the above, there remains a need for an evaporator that is relatively light weight and inexpensive to manufacture. There likewise remains a need for a flake freezing machine and system using the same.

SUMMARY OF THE INVENTION

The purpose and advantages of the invention will be set forth in and apparent from the description and drawings that follow below, as well as will be learned by practice of the invention. Additional advantages of the invention will be realized and attained by the elements of the apparatus particularly pointed out in the appended claims.

To achieve these and other advantages and in accordance with the purpose of the invention, as embodied and broadly described herein, a flake freezing machine is provided for producing frozen flakes using a freezable liquid from a liquid source. Particularly, the present invention includes an evaporator to be incorporated in the flake freezing machine. The evaporator includes a cylindrical structure having an inner surface and an outer surface. The inner surface of the cylindrical structure defines the interior chamber in which the frozen flakes are produced. Additionally, the evaporator includes a tubing assembly located inside the cylindrical structure between the inner surface and the outer surface. The tubing assembly has an inlet for introducing a refrigerating fluid into the tubing assembly and an outlet for discharging the refrigerating fluid from the tubing assembly after the refrigerating fluid has circulated therethrough. Circulation of the refrigerating fluid cools the inner surface of the cylindrical structure to a temperature sufficient to freeze the liquid.

In accordance with the present invention, and in addition to the evaporator, the flake freezing machine includes a rotatable shaft positioned within the interior chamber of the evaporator. The rotatable shaft is rotated by a drive mechanism, and is in alignment with a central axis of the interior chamber. A nozzle is provided on the rotatable shaft in fluid communication with the liquid source for distributing the liquid toward the inner surface of the cylindrical structure during rotation of the rotatable shaft. In this manner, the liquid distributed from the nozzle freezes on the inner surface of the cylindrical structure as a frozen sheet when the refrigerating fluid is being circulated through the tubing assembly of the evaporator. Also provided on the rotatable shaft is a blade member for removing the frozen sheet from the inner surface of the cylindrical structure in the form of flakes.

With regard to the preferred embodiment of the invention, the tubing assembly of the evaporator is a stainless steel tubular pipe wound in a helical configuration, and the cylindrical structure of the evaporator is an aluminum cast construction with the tubing assembly embedded therein. Preferably, a layer of chrome is provided on at least the inner surface of the cylindrical structure. Also included in the preferred embodiment of the invention is a liquid distribution pan positioned on the rotatable shaft, a basin located along a lower portion of the cylindrical structure for collecting the liquid from the inner surface of the cylindrical structure, and a sump pump for recirculating the liquid from the basin into the liquid distribution pan. Additional preferred features of the flake freezing machine include an optional wiper member on the rotatable shaft to remove excess liquid from the frozen sheet that is formed on the inner surface of cylindrical structure, and a deflector shield positioned below the blade member for deflecting the frozen flakes that are removed from the inner surface of the cylindrical structure toward a central discharge opening.

The objects and advantages of the present invention are further achieved by a flake freezing system, including the flake freezing machine described above. The flake freezing system further includes, among other things, an accumulator in fluid communication with the outlet of the tubing assembly to accumulate the refrigerating fluid from the tubing assembly after circulating therethrough; a compressor in fluid communication with the accumulator to pressurize the refrigerating fluid from the accumulator; a condenser in fluid communication with the compressor to condense the pressurized refrigerating fluid from the compressor; and a heat exchanger in fluid communication with the condenser and the inlet of the tubing assembly of the evaporator to pre-cool the condensed refrigerating fluid from the condenser prior to being introduced into the inlet of the tubing assembly. Preferably, the heat exchanger likewise is in fluid communication with the accumulator, such that pre-cooling of the condensed refrigerating fluid is accomplished by using the refrigerating fluid from the accumulator.

An additional feature of the preferred embodiment of the flake freezing system includes a controller in electrical communication with the drive mechanism and sump pump of the flake freezing machine, as well as the compressor to control operation of the flake freezing system automatically. A sensor also can be provided to determine when a sufficient amount of frozen flakes has been produced. In this manner, the controller preferably is in communication with the sensor to deactivate the flake freezing system when the sufficient amount of frozen flakes is produced.

It is to be understood that both the foregoing general description and the following detailed description are exemplary and are provided for purposes of explanation only, and are not restrictive of the invention, as claimed.

BRIEF DESCRIPTION OF THE DRAWINGS

The accompanying drawings, which are incorporated in and constitute a part of this specification, illustrate the preferred embodiment of the invention, and together with the description, serve to explain the principles of the invention.

DETAILED DESCRIPTION OF THE PREFERRED EMBODIMENT

Figure 1A:
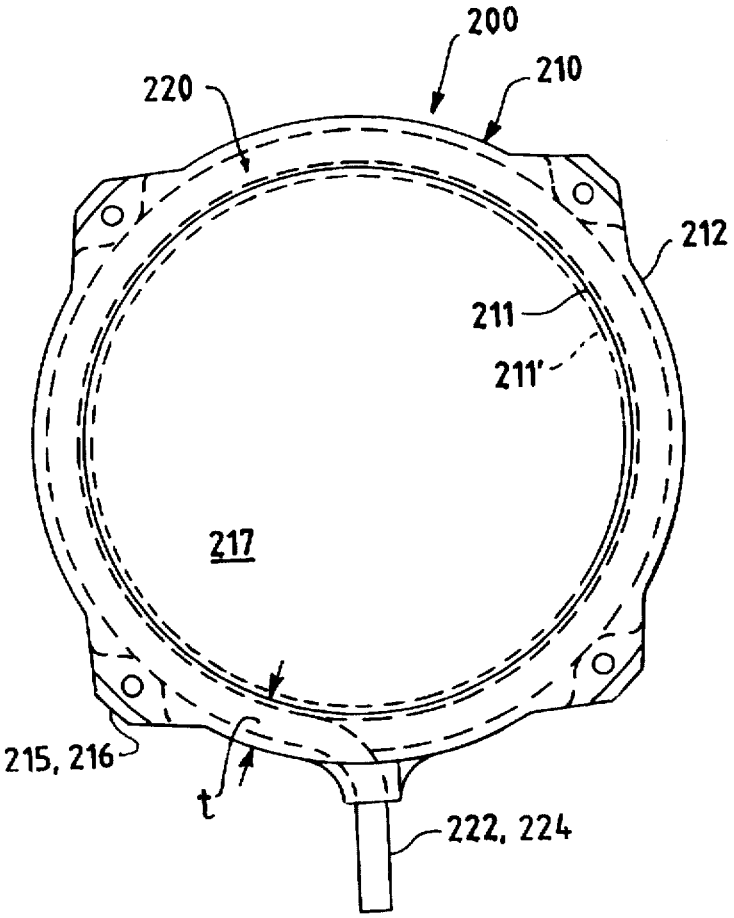
FIG. 1A is a top view of a representative embodiment of the evaporator of the present invention.

Reference will now be made in detail to the present preferred embodiment of the evaporator, as well as to the flake freezing machine and system, of the present invention. Examples are illustrated in the accompanying drawings. Wherever possible, the same reference characters will be used throughout the drawings to refer to the same or like parts. The operation of the present invention will be described in conjunction with the detailed description of the flake freezing machine and flake freezing system for clarity.

In accordance with the present invention, a flake freezing machine is provided for producing frozen flakes using a freezable liquid from a liquid source. Generally, the freezable liquid is either fresh water, sea water or a water-based solution. The liquid source therefore would include tanks, wells, reservoirs or public water supply lines, as well as any naturally occurring water source. However, any other freezable liquid may be used with the flake freezing machine and system of the present invention for the production of frozen flakes. Examples of such freezable liquids include, but are not limited to, flavored beverages, juices and oils, as well as medicinal and bodily liquids. For operation of the present invention, the liquid source for these freezable liquids typically will include tanks, vats or other similar reservoirs.

Figure 1B:
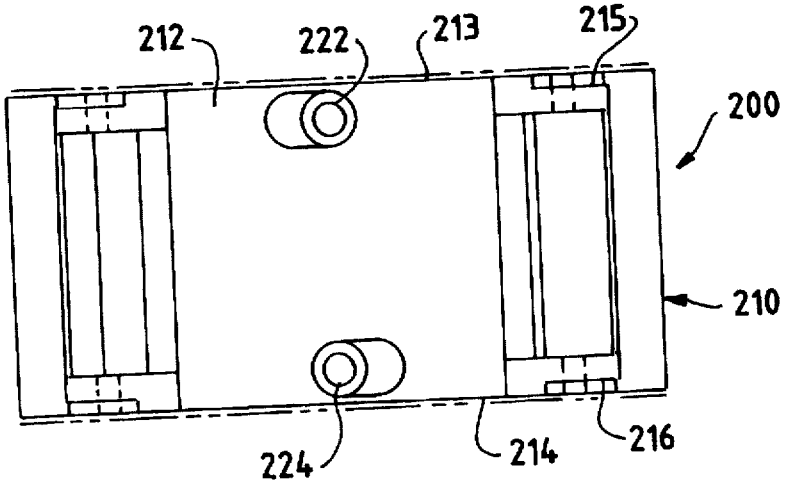
FIG. 1B is a side view of the evaporator shown in FIG. 1A.

The flake freezing machine of the present invention, designated generally herein by the reference character 100, operates by freezing the liquid from the liquid source as a frozen sheet on the surface of an evaporator, and then removing the frozen sheet from the surface of the evaporator in the form of frozen flakes. FIGS. 1A and 1B show a representative embodiment of the evaporator 200 of the present invention. As seen in FIG. 1A, the evaporator 200 includes a cylindrical structure 210 having an inner surface 211 and an outer surface 212. The inner surface 211 is generally cylindrical in shape and defines an interior chamber 217 wherein the frozen flakes are produced. Extending from the outer surface 212 are upper and lower mounting flanges 215, 216 used for mounting, and thus incorporating, the cylindrical structure 210 within the flake freezing machine 100 of the present invention. Although FIG. 1A shows that the outer surface 212 also is generally cylindrical in shape, it is possible for the outer surface 212 of the cylindrical structure 210 to have a polyhedral or similar geometric shape.

Located inside the cylindrical structure 210 between the inner surface 211 and the outer surface 212 is a tubing assembly 220. As shown in FIGS. 1A and 1B, the tubing assembly 220 has an inlet 222 for introducing a refrigerating fluid into the tubing assembly 220 and an outlet 224 for discharging the refrigerating fluid from the tubing assembly 220 after the refrigerating fluid has circulated therethrough.

In this manner, and as described in greater detail below with regard to operation of the flake freezing system, circulation of the refrigerating fluid through the tubing assembly 220 cools the inner surface 211 of the cylindrical structure 210 to a temperature sufficient to freeze the liquid, preferably to about 0° F. when water or a water-based solution is to be frozen. Although the particular refrigerating fluid is not limited by the present invention, such known refrigerating fluids that may be used include R-12, R-22, R-502, R-134A, R-404A and R-507, as well as R-717.

Figure 2A:
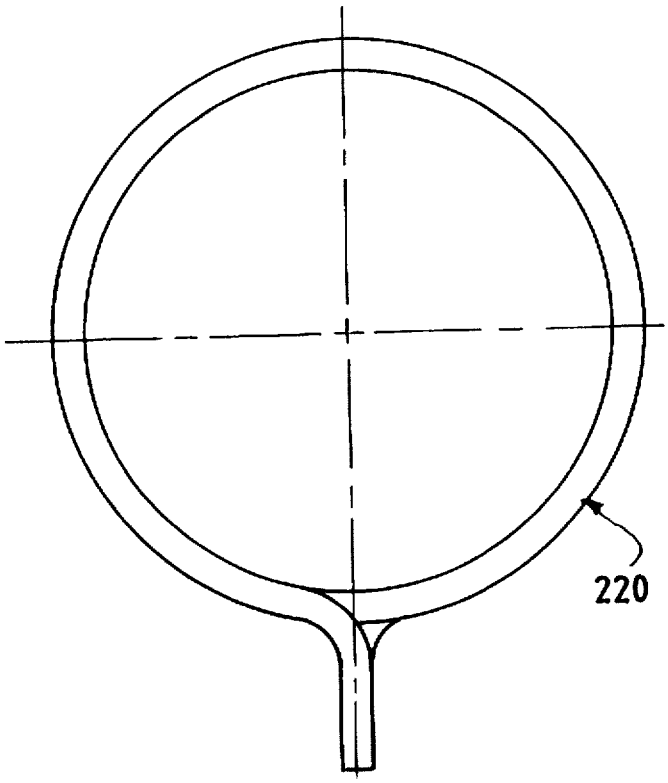
FIG. 2A is a top view of a representative embodiment of the tubing assembly used in the evaporator shown in FIGS. 1A and 1B.

A variety of configurations may be used for the tubing assembly 220 within the cylindrical structure 210. Likewise, more than one tubing assembly 220 may be provided, each having an inlet 222 and outlet 224 for circulation of refrigerating fluid therethrough. In the preferred embodiment, however, and as show in FIGS. 2A and 2B, the tubing assembly 220 includes a length of tubular pipe that is wound into a helical configuration. Specifically, the helical configuration of the tubing assembly 220 is dimensioned such that the inner diameter of the helix is slightly larger than the diameter corresponding to the inner surface 211 of the cylindrical structure 210, while the outer diameter of the helix is generally smaller than the diameter or similar cross dimension corresponding to the outer surface 212 of the cylindrical structure 210. The outer diameter of the tubular pipe therefore is generally less than the thickness "t" of the cylindrical structure 210 between the inner surface 211 and the outer surface 212.

Figure 2B:
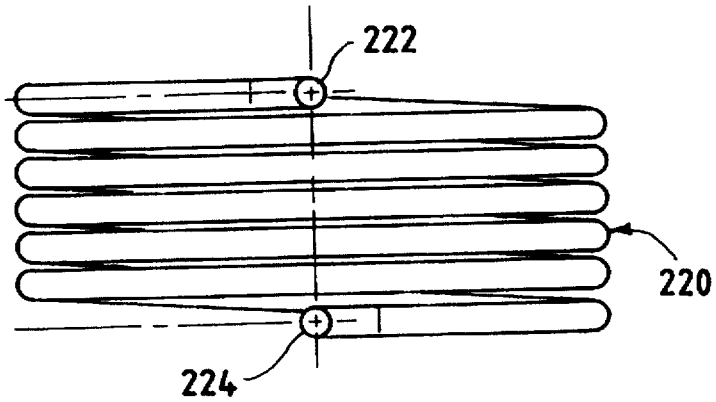
FIG. 2B is a side view of the tubing assembly shown in FIG. 2A.

FIGS. 1A and 1B further show that the inlet 222 and outlet 224 for the tubing assembly 220 extend from the outer surface 212 of the cylindrical structure 210. In this manner, the inlet 222 and outlet 224 have exposed ends outside of the cylindrical structure 210 so as to be connected for fluid communication with additional components of a flake freezing system of the present invention, as will be described below. Threaded couplings or similar connectors may be provided on the exposed ends of the inlet 222 and outlet 224 for connecting the evaporator 200 to these additional flake freezing system components. Alternatively, the exposed ends of the inlet 222 and outlet 224 may be prepared for a welded connection. Although the inlet 222 of the tubing assembly 220 shown in FIGS. 1B and 2B is located along the upper portion of the cylindrical structure 210 and the outlet 224 is located along the lower portion, the location of the inlet 222 and outlet 224 may be reversed if desired. Rather than extending from the outer surface 212, the inlet 222 and outlet 224 likewise may be configured to extend from the upper or lower surfaces 213,214 of the cylindrical structure 210.

Figure 3:
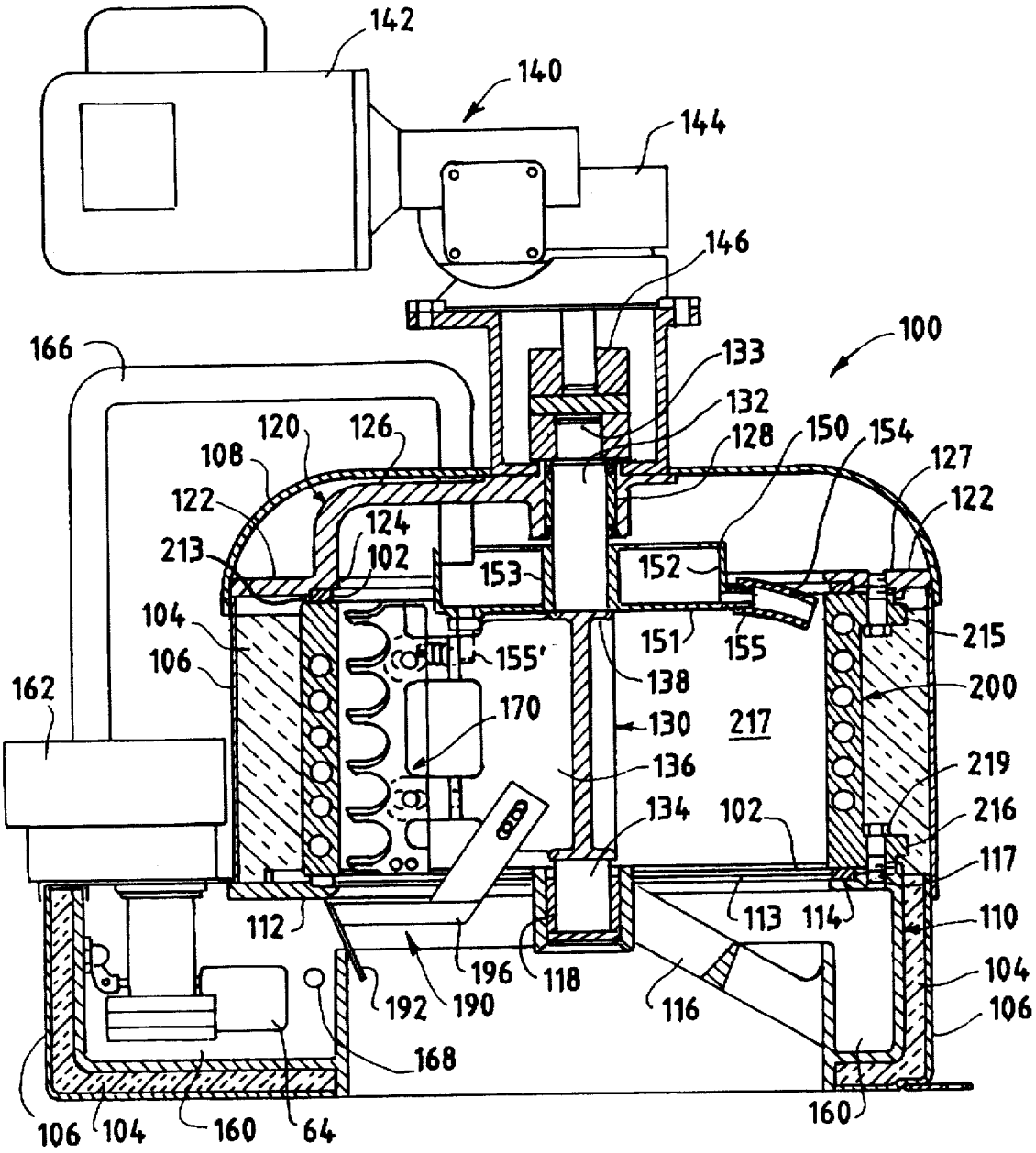
FIG. 3 is a cross-sectional side view of a representative embodiment of the flake freezing machine of the present invention having the evaporator of FIGS. 1A and 1B incorporated therein.

As embodied herein, and in accordance with the present invention, the evaporator 200 is made of a cast construction, such that the tubing assembly 220 is embedded in the cylindrical structure 210 as shown in FIG. 3. Using known techniques, this is accomplished by placing the tubing assembly 220 within a mold corresponding to the overall shape of the cylindrical configuration, and then pouring or similarly providing, in molten form, the material of construction selected for the cylindrical structure 210. The preferred embodiment of the evaporator 200 includes a stainless steel tubular pipe for the tubing assembly 220, and aluminum for the selected material of construction for the cylindrical structure 210. However, alternative materials of construction likewise may be used for the tubing assembly 220 and selected for the cylindrical construction. For example, carbon steel, titanium, copper or brass may be used for the tubing assembly 220, while magnesium, iron, steel, copper or brass may be selected for the material of construction for the cylindrical structure 210.

When the molten material for the cylindrical structure 210 is introduced into the mold during construction of the evaporator 200, the tubing assembly 220 typically will expand and shift due to thermal expansion. The tubing assembly 220 therefore should be preheated and relatively fixed in position before the molten material is introduced to ensure proper alignment of the tubing assembly 220 within the cylindrical structure 210. To construct the evaporator 200 embodied in FIGS. 1A and 1B, for example, the surface of the mold corresponding to the outer surface 212 of the cylindrical structure 210 is provided with inwardly-projecting ridge members. Particularly, the mold used for construction of the evaporator 200 shown in FIGS. 1A and 1B includes four (4) ridge members, each positioned at a circumferential location corresponding to a pair of outwardly extending mounting flanges 215, 216. These ridge members properly hold the tubing assembly 220 in position and prevent shifting due to thermal expansion of the tubing assembly 220, so as to maintain a spaced relationship between the outer diameter of the tubing assembly 220 and the outer diameter of the cylindrical structure 210. Additionally or alternatively, clips or similar known clamping devices may be used to hold the tubing assembly 220 in position, as well as to secure the positions of the inlet 222 and outlet 224 of the tubing assembly 220.

The use of ridge members along the surface of the mold not only hold the tubing assembly 220 in position during construction of the evaporator 200, but also ensure that the tubing assembly 220 is centered and properly aligned after construction is completed. As previously mentioned, the tubing assembly 220 embodied in FIGS. 1A through 2B is dimensioned to have an inner diameter slightly larger than the diameter corresponding to the inner surface 211 of the cylindrical structure 210. The ridge members therefore allow substantially uniform spacing between the inner diameter of the tubing assembly 220 and the inner surface 211 of the cylindrical structure 210 embodied herein, as best shown in FIGS. 1A and 3. In turn, this substantially uniform spacing allows for more uniform cooling of the inner surface 211 of the cylindrical structure 210 during operation of the flake freezing machine 100 and system 1000, as will be described in greater detail below.

After casting of the cylindrical structure 210 is complete, that is, after the molten material of construction selected for the cylindrical structure 210 is sufficiently hardened to allow removal of the cylindrical structure 210 from the mold, the inner surface 211 is machined within a predetermined tolerance to create a smooth surface having a more consistent diameter. For example, the inner surface of the cylindrical structure 210 shown in FIGS. 1A and 1B is machined from its original cast dimension, depicted by broken line 211', to the machined surface depicted by 211. In the preferred embodiment of the evaporator 200, the machined inner surface 211 of the cylindrical structure 210 is plated with a layer of chrome or similar substance, or impregnated with a protective substance, to enhance the sanitation, durability and efficiency of the evaporator 200. Construction of the evaporator 200 of the present invention likewise may include machining the upper and lower surfaces 213, 214 of the cylindrical structure 210 if desired.

Accordingly, the evaporator 200 constructed as described above and embodied herein is incorporated into the flake freezing machine 100 of the present invention. A cross-sectional view of a representative embodiment of the flake freezing machine 100 including the evaporator 200 is shown in FIG. 3 for purpose of illustration, and not limitation. The general structure of the flake freezing machine 100 includes a base structure 110 on which the evaporator 200 is mounted using the lower mounting flanges 216 extending from the outer surface 212 of the cylindrical structure 210, and a top structure 120 that is mounted on the upper surface 213 of the cylindrical structure 210 by similarly using the upper mounting flanges 215 of the cylindrical structure 210. The configuration and construction of the base structure 110 and the top structure 120 are described in greater detail below.

Figure 4:
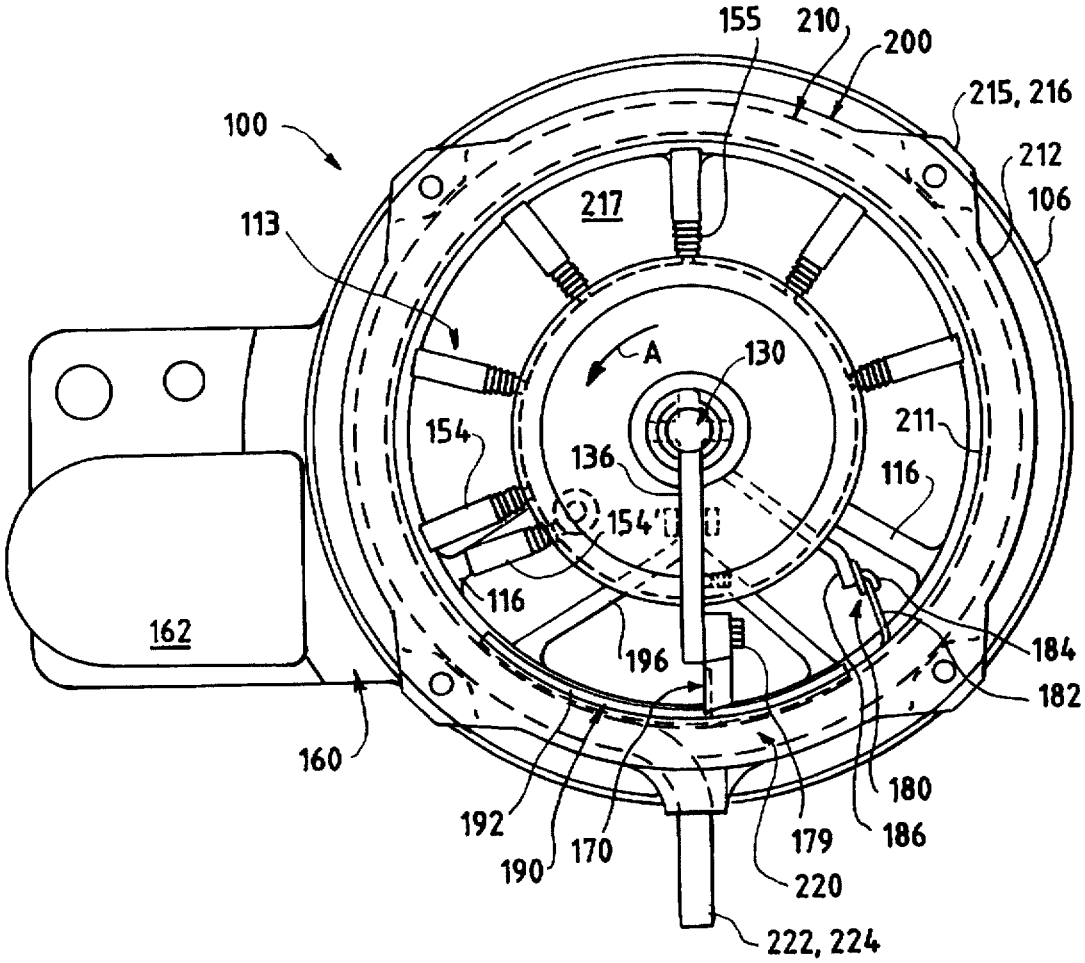
FIG. 4 is a top view of the flake freezing machine shown in FIG. 3, with the housing cover and top structure removed.

An insulation ring 102 made of neoprene, synthetic rubber or similar material preferably is provided between the evaporator 200 and both the base structure 110 and the top structure 120, respectively. Surrounding the base structure 110 and the evaporator 200 is an outer housing 106, which encases insulating material 104 around the outside of the flake freezing machine 100 as well as enhances the overall aesthetics of the flake freezing machine 100. The outer housing 106 preferably is made of plastic or a similar durable, lightweight material, while styrofoam or the like is preferred for the insulating material 104. Additionally, a housing cover 108 is provided to cover the top structure 120 and upper end of the evaporator 200. FIG. 4 shows a top view of the flake freezing machine 100 with the housing cover 108 and top structure 120 removed.

As shown in FIGS. 3 and 4, and in accordance with the present invention, a rotatable shaft 130 is positioned within the interior chamber 217 of the evaporator 200. Particularly, FIG. 4 shows that the rotatable shaft 130 is aligned with the center axis of the interior chamber 217 defined by the inner surface 211 of the cylindrical structure 210 of the evaporator 200. As described in greater detail below, at least one nozzle 154 is provided on the rotatable shaft 130 for distributing the freezable liquid toward the inner surface 211 of the cylindrical structure 210 so as to form a frozen sheet thereon. Additionally, and as further described below, a blade member 170 is mounted on the rotatable shaft 130 for removing the frozen sheet from the inner surface 211 of the cylindrical structure 210 in the form of frozen flakes. The rotatable shaft 130 is rotatably supported at its lower end by the base structure 110, and at its upper end by the top structure 120.

To support the rotatable shaft 130, as well as the evaporator 200, the base structure 110 embodied herein includes a substantially ring-shaped frame 112 having an inner edge 114 defining a central discharge opening 113, which allows for the discharge of frozen flakes that are removed from the inner surface 211 to a bin or similar structure provided below. This central discharge opening 113 generally corresponds with the interior chamber 217 that is defined by inner surface 211 of the cylindrical structure 210 in both shape and size. The ring-shaped frame 112 is provided with mounting holes 117 corresponding with the lower mounting flanges 216, such that the evaporator 200 may be mounted on the base structure 110 with the inner surface 211 of the cylindrical structure 210 in alignment with the inner edge 114 of the ring-shaped frame 112. Threaded bolts 219 or similar fasteners may be used. Extending radially inward from the ring-shaped frame 112 are support members 116 that support a lower shaft bearing 118 in alignment with the central axis of the central discharge opening 113, and thus, the inner surface 211 of the cylindrical structure 210.

The top structure 120 likewise includes a ring-shaped frame 122 having mounting holes 127 corresponding with the upper mounting flanges 215 of the cylindrical structure 210, and an inner edge 124 corresponding with the inner surface 211 in shape and size. Likewise, the top structure 120 includes a number of support members 126 extending radially inward for supporting an upper shaft bearing 128. For example, the base structure 110 and the top structure 120 embodied herein each include three (3) support members extending radially inward. The base structure 110 and the top structure 120 preferably are cast as single piece structures from aluminum, although alternative methods and materials of construction likewise may be used.

With regard to the lower and upper shaft bearings 118, 128, any of a variety of conventional bearing configurations may be used. It is preferred, however, that oil-filled bronze sleeve bearings having corrosion-resistant seals are used with the flake freezing machine 100 embodied herein. Further, the lower shaft bearing 118 preferably includes a stainless steel disk held on an oil-filled thrust plate and "O" ring to provide axial support.

Figure 5B:
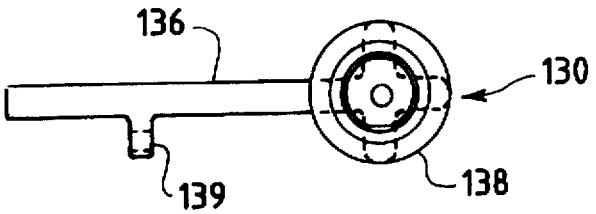
FIG. 5B is a top view of the rotatable shaft shown in FIG. 5A.
Figure 5A:
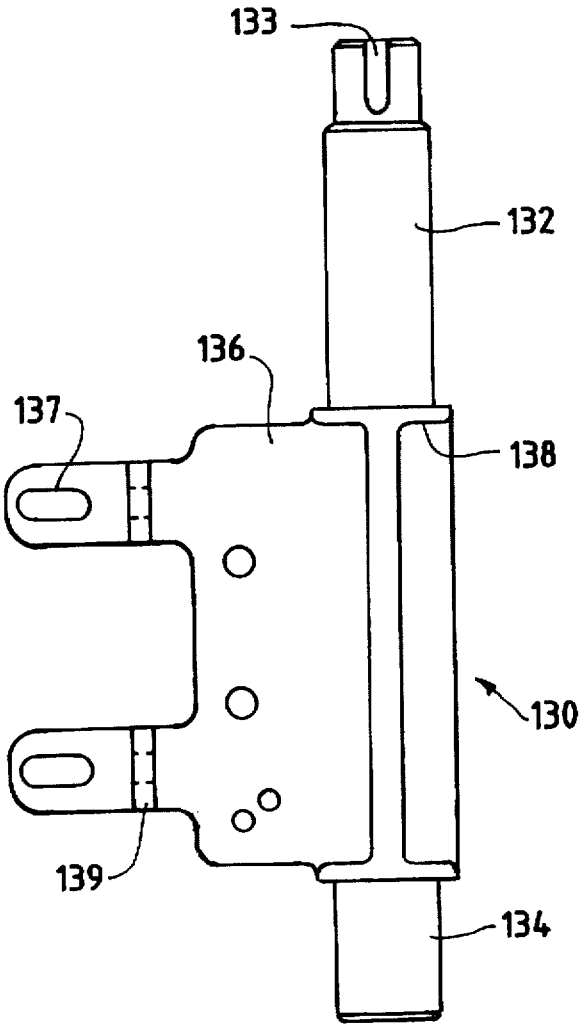
FIG. 5A is a side view of a representative embodiment of the rotatable shaft used in the flake freezing machine shown in FIGS. 3 and 4.

FIGS. 5A and 5B show the preferred embodiment of the rotatable shaft 130 used in the flake freezing machine 100 of the present invention. The upper and lower ends of the rotatable shaft 130 are cylindrical portions 132, 134 that are received by the upper and lower shaft bearings 128, 118, respectively. A web portion 136 is provided at an intermediate location along the length of the rotatable shaft 130 to accommodate the blade member 170 in accordance with the invention, as will be described. At an upper end of the intermediate web portion 136, an outwardly extending flange 138 is provided to support the one or more nozzles 154 used for distributing the freezable liquid, as also will be described. Preferably, the rotatable shaft 130 is constructed as a single-piece, stainless steel member including the upper and lower cylindrical portions 132, 134, as well as the intermediate web portion 136 and upper flange 138. This is accomplished by investment casting the rotatable shaft 130 in a permanent mold, and then machining the cylindrical portions 132, 134 to smooth the surfaces and enhance dimension tolerances. In this manner, the intermediate portion of the rotatable shaft 130 can be constructed with a reduced cross-sectional area, as best seen in FIG. 5B, without compromising the strength of the rotatable shaft 130. Alternatively, the rotatable shaft 130 may be constructed of a material other than stainless steel, such as carbon steel or ductile iron if desired, or may be constructed of two or more parts welded or similarly assembled together. At the upper end of the rotatable shaft 130 is a groove 133 or similar element for engagement with a drive mechanism 140 that rotates the rotatable shaft 130 about the central axis of the interior chamber 217.

The drive mechanism 140 of the flake freezing machine 100 embodied herein is mounted on the top structure 120 above the evaporator 200 and rotatable shaft 130. This configuration allows for easy service and replacement. Preferably, the drive mechanism 140 is a conventional drive motor 142 having a worm-and-gear speed reducer 144, as is available from Peerless-Winsmith of Springville, N.Y. The speed reducer 144 includes a flexible coupling 146 extending downwardly for engagement with the groove 133 or similar element provided at the upper end of the rotatable shaft 130. The rotatable shaft 130 therefore is rotated at a preferred speed of about 1–3 rpm. Alternative drive mechanisms may be used, however, if desired.

As noted above, and in accordance with the present invention, at least one nozzle 154 is provided on the rotatable shaft 130 for distributing the freezable liquid toward the inner surface 211 of the cylindrical structure 210 of the evaporator 200 during rotation of the rotatable shaft 130. The nozzle 154 therefore is provided in fluid communication with the liquid source described above. In the preferred embodiment of the present invention, this is accomplished by positioning a liquid distribution pan 150 on the rotatable shaft 130. Particularly, the liquid distribution pan 150 is positioned on and supported by the outwardly extending flange 138 at the upper end of the intermediate web portion 136 so as to rotate with the rotatable shaft 130. With the nozzle 154 extending from the liquid distribution pan 150, fluid communication with the liquid source is provided by a flow line 166 extending through the housing cover 108 and into the liquid distribution pan 150.

The liquid distribution pan 150 preferably is a substantially cylindrical dish having a bottom wall 151, an outer diameter wall 152, and an inner diameter wall 153 defining a central aperture corresponding in shape and size with the upper cylindrical portion 132 of the rotatable shaft 130, as shown in FIGS. 3 and 4. The liquid distribution pan 150 therefore is positioned on the rotatable shaft 130 by sliding the upper cylindrical portion 132 of the rotatable shaft 130 through the central aperture until the outwardly extending flange 138 engages the bottom wall 151. A key and notch or similar configuration may be provided to ensure that the liquid distribution pan 150 rotates with the rotatable shaft 130.

Extending radially from the outer diameter wall 152 of the liquid distribution pan 150 is at least one nozzle 154. In the preferred embodiment, and as best shown in FIG. 4, a plurality of nozzles 154 are provided spaced radially from each other. In this manner, the nozzles 154 likewise rotate with the rotatable shaft 130, such that freezable liquid is continuously and repeatedly distributed onto the inner surface 211 of the cylindrical structure 210 of the evaporator 200 to increase the uniformity and thickness of the frozen sheet frozen thereon before removal by the blade member 170, as will be described. At least one lower nozzle 154' also is provided so as to extend from the bottom wall 151 of the liquid distribution pan 150. This lower nozzle 154' allows increased initial flooding of the inner surface during each rotation of the rotatable shaft, as well as enables liquid distribution during low supply conditions and drainage of the liquid distribution pan 150 when operation of the flake freezing machine 100 is deactivated.

The liquid distribution pan 150 and nozzles 154 may be fabricated using a variety of methods and materials. In the preferred embodiment, however, the liquid distribution pan 150 is injection molded using a suitable plastic material. Integrally fabricated as part of the liquid distribution pan 150 are hollow ribbed connectors 155 extending radially from the outer diameter wall 152. Nozzles 154 therefore are provided as plastic or metal tubes that are easily force-fitted over the hollow ribbed connectors. The lower nozzle 154', also made of either plastic or metal, is attached separately using a conventional threaded coupling.

During operation of the flake freezing machine 100, freezable liquid is evenly distributed onto the inner surface 211 of the cylindrical structure 210 from the nozzles 154 as the rotatable shaft 130 is rotated about the central axis of the interior chamber 217. Because the inner surface 211 is sufficiently cooled to freeze the liquid due to the circulation of refrigerating fluid through the tubing assembly 220, the evenly distributed liquid freezes into a frozen sheet as it flows down the inner surface 211. It is expected during certain operating conditions, however, that a portion of the distributed liquid will not freeze before it reaches the lower portion of the inner surface 211. Therefore, and in accordance with an additional aspect of the present invention, a basin 160 is located along the lower portion of the cylindrical structure 210.

For purpose of illustration, and as shown in FIG. 3, the basin 160 of the flake freezing machine 100 embodied herein is integrally incorporated as part of the base structure 110. Particularly, the basin 160 is configured to surround the central discharge opening 113 that is provided in the ring-shaped frame 112 of the base structure 110 so as to collect the liquid that flows down the inner surface 211 of the cylindrical structure 210 without freezing. For enhanced operation, the inner edge 114 of the ring-shaped frame 112 that defines the central discharge opening 113 therethrough is chamfered so as direct the flowing liquid from the inner surface 211 of the cylindrical structure 210 toward the basin 160 due to surface tension of the freezable liquid.

Once collected in the basin 160, the liquid preferably is recirculated by a sump pump 162 to the liquid distribution pan 150 for enhanced efficiency. Additionally, and in accordance with the preferred embodiment of the invention, the freezable liquid from the liquid source is first introduced into the basin 160 rather than directly into the liquid distribution pan 150. A float valve 164 or similar device is connected to the liquid source and an overflow fitting 168 or relief valve is provided to ensure that the freezable liquid in the basin 160 is maintained at a predetermined level. This configuration thus minimizes the number of flow lines required to extend through the housing cover 108, and enhances both the control and operation of the sump pump 162. It therefore is understood, with regard to this embodiment, that the nozzles 154 extending from the liquid distribution pan 150 are in fluid communication with the liquid source via the basin 160, the sump pump 162, and the flow line 166 extending from the sump pump 162 to the liquid distribution pan 150.

Further in accordance with the present invention, and as mentioned above, the flake freezing machine 100 also includes a blade member 170 mounted on the rotatable shaft 130 for removing the frozen sheet that is frozen on the inner surface 211 of the cylindrical structure 210 of the evaporator 200. Particularly, FIGS. 3 and 4 show that the blade member 170 is mounted so as to extend radially from the rotatable shaft 130, while FIG. 4 further shows that the blade member 170 is mounted behind the last nozzle 154 relative to the direction of rotation of the rotatable shaft 130 as depicted by arrow A. The blade member 170 therefore travels behind the last nozzle 154 to remove the frozen sheet from the inner surface 211 of the cylindrical structure 210 in the form of frozen flakes.

Figure 6B:
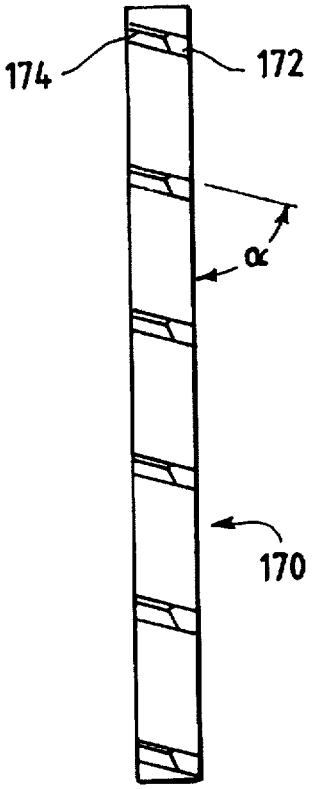
FIG. 6B is an edge view of the blade member shown in FIG. 6A.
Figure 6A:
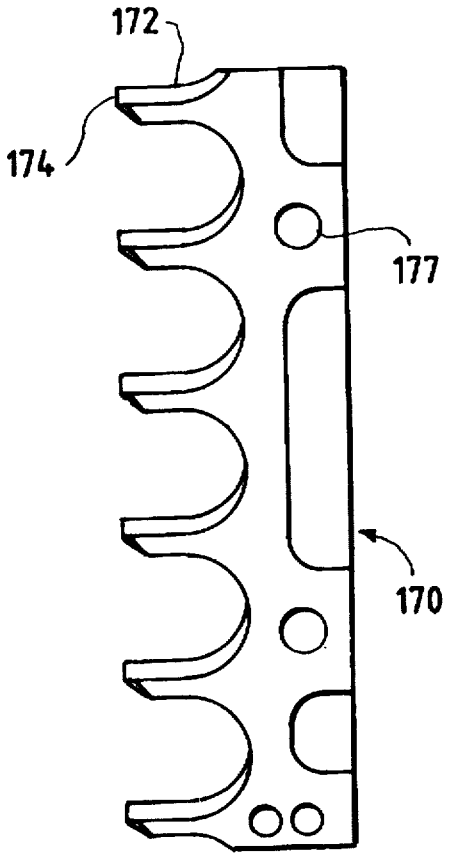
FIG. 6A is a side view of a representative embodiment of the blade member used in the flake freezing machine shown in FIGS. 3 and 4.

Additionally, FIGS. 3 and 4 both show that the blade member 170 does not contact the inner surface 211 of the cylindrical structure 210 so as to prevent excessive wear and inadvertent jamming. FIGS. 6A and 6B therefore show a preferred embodiment of the blade member 170 for the flake freezing machine 100 and system 1000 of the present invention. The blade member 170 is an elongated member having at least one finger element 172 for breaking the frozen sheet that is formed on the inner surface 211 of the cylindrical structure 210 into frozen flakes. Preferably, a plurality of finger elements 172 are spaced along the length of the elongated member. FIG. 6B further shows that each finger element 172 is angled laterally across the edge of the blade member 170, preferably between an angle $\alpha$ of about 70° and 80°, and is provided with a sharpened outermost end 174. In this manner, each finger element 172 acts as a wedge that digs into and breaks apart the frozen sheet without contacting or destroying the inner surface 211 of the cylindrical structure 210. Alternatively, the blade member 170 may be provided with an elongated blade edge for shaving frozen flakes from the frozen sheet without contacting the inner surface 211.

As with the rotatable shaft 130, the blade member 170 preferably is constructed of stainless steel by investment casting and subsequent machining to specification, although alternative materials and methods of construction may be used. To mount the blade member 170 on the rotatable shaft 130, mounting holes 177 are provided through the blade member 170 as well as through the intermediate web portion 136 of the rotatable shaft 130. Conventional threaded fasteners 179 or the like secure the members together, as shown in FIG. 4A. Preferably, the mounting holes 137 in the intermediate web portion 136 are elongated to allow adjustment and compensation for various blade member 170 sizes and tolerances. An adjustment assembly 139, including a flange and adjustment screw (not shown), also is provided along the intermediate web portion 136 of the rotatable shaft 130 to further assist in positioning of the blade member 170.

As previously noted, FIG. 4 shows that the blade member 170 is mounted behind the last nozzle 154 relative to the direction of rotation of the rotatable shaft 130. It is preferred that the frozen flakes removed from the inner surface 211 of the cylindrical structure 210 are as dry as possible. Therefore, and in accordance with another aspect of the present invention, a wiper member 180 also is included on the rotatable shaft 130 in a position before the blade member 170 relative to the rotation of the rotatable shaft 130 as depicted by arrow A in FIG. 4. The wiper member 180, which is not shown in FIG. 3 for clarity, preferably is a resilient strip 182 of neoprene or similar material secured within a metal or similarly durable bracket 184. As shown in FIG. 4, the wiper member 180 embodied herein is mounted directly to the intermediate web portion 136 of the rotatable shaft 130 using a substantially L-shaped member 186 so as to be positioned before the blade member 170.

To ensure that the frozen flakes removed by the blade member 170 are as dry as possible, the wiper member 180 removes excess liquid, which is not yet frozen, from the frozen sheet on the inner surface 211 prior to contact by the blade member 170. The excess liquid removed by the wiper member 180 flows down into the basin 160, and is then recirculated by the sump pump 162 back into liquid distribution pan 150 for reuse. Because this liquid has been significantly cooled by contact with the frozen sheet, which in turn cools the recirculated liquid in the basin 160, the efficiency of the flake freezing machine 100 is further enhanced by the wiper member 180. That is, less energy will be required to subsequently freeze the liquid that has been already cooled by initial contact with the frozen sheet on the inner surface 211 of the cylindrical structure 210.

FIGS. 3 and 4 also show that a deflector shield 190 is mounted on the rotatable shaft 130 and positioned below the blade member 170 of the flake freezing machine 100 embodied herein. Particularly, FIG. 3 shows that the deflector shield 190 is positioned immediately below the inner edge 114 of the ring-shaped frame 112 of the base structure 110, and is angled inwardly so as to cover the basin 160 below the blade member 170. The deflector shield 190 generally includes an arcuate member 192 of metal or similar durable material that is mounted to the rotatable shaft 130 by an extension arm 196 secured to the intermediate web portion 136. In this manner, the deflector shield 190 remains below and travels along with the blade member 170 so as to deflect frozen flakes that are removed from the inner surface 211 of the cylindrical structure 210 by the blade member 170 toward the central discharge opening 113. Frozen flakes therefore are prevented from falling into the basin 160, and thus, possibly clogging the sump pump 162 and flow line 166 extending back to the liquid distribution pan 150.

In addition to the evaporator 200 and flake freezing machine 100 described above, and further in accordance with the present invention, a flake freezing system designated generally by reference character 1000 also is provided for producing frozen flakes using freezable liquid from a liquid source. Particularly, the flake freezing system 1000 not only includes the evaporator 200 and flake freezing machine 100 of the present invention, but also includes components of a refrigeration cycle that are used to control and handle the refrigerating fluid throughout the refrigeration cycle. Any of a variety of refrigerating fluids may be used with this flake freezing system, including R-12, R-22, R-502, R-134A, R-404A and R-507, as well as R-717. A representative embodiment of the flake freezing system 1000 is shown in FIG. 7.

Figure 7:
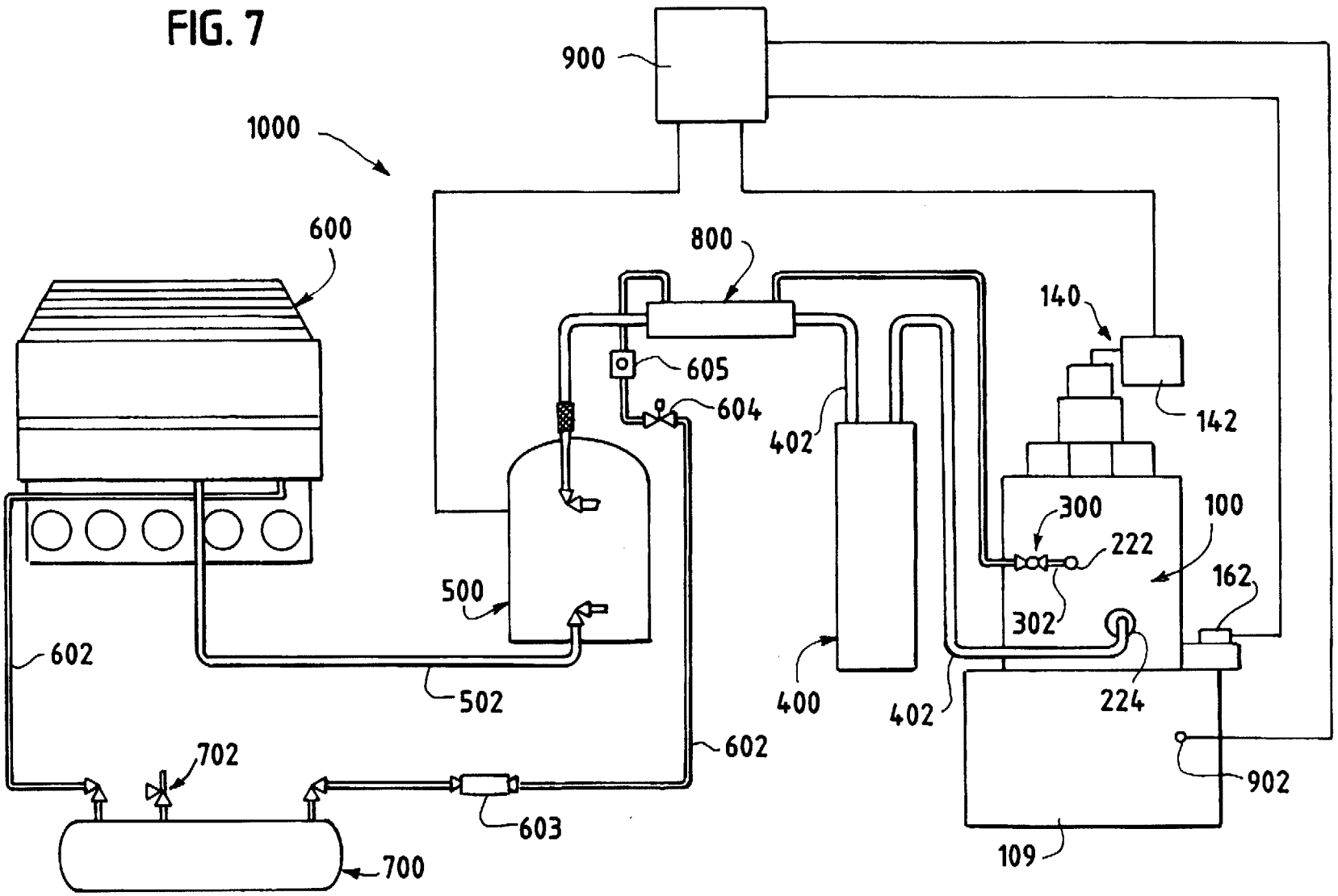
FIG. 7 is a schematic representation of the flake freezing system of the present invention using the flake freezing machine shown in FIGS. 3 and 4.

As previously noted, and as shown in FIG. 7, the flake freezing system 1000 of the present invention includes the flake freezing machine 100 having the evaporator 200 described above. Connected to and in fluid communication with the inlet 222 of the tubing assembly 220 of the evaporator 200 is a liquid flow line 302 for introducing the refrigerating fluid into the tubing assembly 220. This liquid flow line 302 is located immediately downstream of a thermostatic expansion valve 300, which regulates the flow and pressure of the refrigerating fluid, and thus marks the beginning of the low pressure side of the refrigeration cycle of the flake freezing system 1000. The thermostatic expansion valve 300 may be operated manually, remotely, or automatically using temperature and pressure sensors. Conventional thermostatic expansion valves that are suitable for this application are well known and available from Sporlan Valve Co. of St. Louis, Mo. and others.

As the refrigerating fluid circulates through the tubing assembly 220 of the evaporator 200 within the flake freezing machine 100, the refrigerating fluid flashes to vapor by absorbing its latent heat of vaporization from the inner surface 211 of the cylindrical structure 210, and thus, from the freezable liquid distributed thereon by the nozzles 154 of the flake freezing machine 100. In this manner, the inner surface 211 of the cylindrical structure 210 of the evaporator 200 is cooled to a temperature sufficient to freeze the liquid, preferably at approximately 0° F. if water or a water-based solution is to be frozen. As described in detail above, a frozen sheet is thus formed on the inner surface 211 of the cylindrical structure 210 of the evaporator 200 and then removed as frozen flakes by the blade member 170 mounted on the rotatable shaft 130. The frozen flakes fall through the central discharge opening 113 into a bin 109 positioned below the flake freezing machine 100.

The refrigerating fluid, now substantially a low pressure vapor, is discharged from the tubing assembly 220 through the outlet 224 and a discharge flow line 402 in fluid communication therewith to an accumulator 400. The accumulator 400 is provided to accumulate or collect any refrigerating fluid discharged from the tubing assembly 220 of the evaporator 200 that is still in liquid form. This prevents entrained liquid from passing downstream and possibly damaging sensitive components of the flake freezing system 1000. The liquid refrigerating fluid that is collected in the accumulator 400 can then vaporize and flow downstream in vapor form. Such accumulators are known and readily available from AC&R of Chatham, Ill.

Preferably, a suction is drawn on the discharge flow line 402 and accumulator 400 to enhance the efficiency of the refrigerating fluid flow therethrough. This suction is provided by a compressor 500, as shown in FIG. 7, which is located downstream of and in fluid communication with the accumulator 400. The compressor 500 not only draws a suction on the flow line 402, and thus circulates the refrigerating fluid through the flake freezing system 1000, but also compresses the refrigerating fluid from the accumulator 400 into a high pressure vapor. The compressor 500 therefore marks the beginning of the high pressure side of the refrigeration cycle of the flake freezing system 1000. Any of a variety of suitable compressors may be used for this purpose, such as are available from Copeland of Sidney, Ohio. As the refrigerating fluid is compressed by the compressor 500, however, it also increases in temperature. That is, the refrigerating fluid discharged from the compressor 500 is a high pressure, superheated vapor.

FIG. 7 further shows that a condenser 600 is provided downstream of and in fluid communication with the compressor 500 via a high pressure vapor flow line 502 to condense the refrigerating fluid discharged from the compressor 500. Specifically, the condenser 600 cools the high pressure, superheated vapor until the condensation temperature of the refrigerating fluid is reached. At this point, the refrigerating fluid condenses to a pressurized liquid and then is discharged through a liquid discharge flow line 602. Cooling within the condenser 600 may be accomplished by passing the refrigerating fluid through tube bundles that are in contact with a cooling agent, such as an air flow or a liquid flow, including potable water, sea water or the like. Conventional condensers suitable for this application are available from Heatcraft Division of Stone Mountain, Ga., Standard Refrigeration of Melrose Park, Ill., and others.

The refrigerating fluid discharged from the condenser 600 may be directed back to the inlet 222 of the tubing assembly 220 via the thermostatic expansion valve 300 for reuse. In the preferred embodiment of the present invention, however, and as shown in FIG. 7, a receiver 700 is provided in fluid communication with the liquid discharge flow line 602 of the condenser 600. The receiver 700 receives the refrigerating fluid from the condenser 600 and operates as a temporary storage space for this pressurized liquid. A relief valve 702 is provided to prevent over-pressurization and to exhaust refrigerating fluid that is still in vapor form.

The preferred embodiment of the flake freezing system 1000 also includes a heat exchanger 800 located between and in fluid communication with the condenser 600 and the inlet 222 of the tubing assembly 220 of the evaporator 200. Particularly, the heat exchanger 800 is located downstream of the receiver 700 and upstream of the flake freezing machine 100. The heat exchanger 800 pre-cools the refrigerating fluid from the condenser 600, which is a pressurized liquid, prior to introducing the refrigerating fluid back to the inlet 222 of the tubing assembly 220 via the thermostatic expansion valve 300. As with the condenser 600, this is accomplished by passing the pressurized liquid from the condenser 600 through an inlet into tube bundles, which are in contact with a cooling agent. The preferred embodiment of the present invention uses the refrigerating fluid from the accumulator 400. That is, the heat exchanger 800 includes a second inlet in fluid communication with the accumulator 400 as shown in FIG. 7, so as to allow the refrigerating fluid that is drawn from the accumulator 400 by the suction of the compressor 500 to contact and cool the tube bundles of the heat exchanger 800. In this manner, the refrigeration fluid passing through the tube bundles is pre-cooled and then returned to the inlet 222 of the tubing assembly 220 via the thermostatic expansion valve 300 to repeat the refrigeration cycle.

Additional components that may be located along the liquid discharge flow line 602 include a filter drier 603, a solenoid valve 604 to regulate the flow of the refrigerating fluid, and a liquid indicator 605 to ensure that vapors are not trapped within the line 602.

Operation of the present invention is further simplified by providing a controller 900 in electrical communication with various components of the flake freezing system 1000. For example, and as further shown in FIG. 7, a controller 900 may be electrically connected to the drive mechanism 140 and the sump pump 162 of the flake freezing machine 100, as well as to the compressor 500. In this manner, operation of the flake freezing system 1000 can be controlled remotely from a central location, or automatically by providing input signals from various sensors along the system. Such sensors (not shown) include conventional temperature and pressure sensors, as well as electric load sensors to determine when a component is operating properly. A level sensor 902 also can be provided on the bin 109 to determine when a sufficient amount of frozen flakes has been produced. The level sensor 902 may be a photo electric eye or similar device. By providing the level sensor 902 in communication with the controller 900, operation of the flake freezing system 1000 can be deactivated when a sufficient amount of frozen flakes is produced. Such controllers and sensors are well known and available from Banner Engineering Corp. of Minneapolis, Minn. and others.

For purpose of illustration and explanation, and not by limitation, reference is now made to the specific details of a particular embodiment of the flake freezing machine of the present invention. That is, for a flake freezing system capable of producing 1200 pounds of frozen ice flakes daily from a fresh water source using R-404A refrigerating fluid, a flake freezing machine in accordance with the present invention is provided, wherein the flake freezing machine includes an evaporator having a cast aluminum cylindrical structure with a chrome plated inner surface; the inner diameter of the cylindrical structure being about 11 inches, the outer diameter being about 13 inches, and the height being about 6⅜ inches. Embedded within the cylindrical structure is a tubing assembly including 230 inches of 304 stainless steel tubular pipe having an outer diameter of ⅝ inches and a wall thickness of 0.035 inches, wherein the tubular pipe is wound into a helical configuration having an inner diameter of about 11¼ inches and an overall height of about 5 inches. The stainless steel rotatable shaft positioned within the interior chamber of the evaporator is about 11¾ inches long with an outer diameter of about 1¼ inches at its upper and lower ends, and includes an intermediate web portion about 5¾ inches long and about ⅜ inches thick that extends radially from the center of the rotatable shaft about 4½ inches with an outwardly extending flange having a diameter of about 1½ inches at its upper and lower ends. The stainless steel blade member mounted on the intermediate web portion of the rotatable shaft is about 6¼ inches long and ½ inches thick, and includes six (6) one-inch long finger elements spaced approximately one inch apart. Additional features of this particular embodiment of the flake freezing machine include a Baldor drive motor, Specification No. 33-1951-933G1; a Peerless-Winsmith speed reducer, Model 915 MDVD; and a Hartell water pump, Model 950518A. For this particular embodiment of the flake freezing machine, the inner surface of the cylindrical structure is cooled to about 0° F. and no wiper blade is required.

The flake freezing system of this particular embodiment further includes an AC&R suction accumulator, Model S-7046; a Doucette heat exchanger, Model SLHE-1½; and a Copeland compressor, Model CS14K6E-PFV-280; each on the low pressure side of the refrigeration cycle downstream of the flake freezing system. These low pressure components are connected in fluid communication by a ⅞ inch diameter copper pipe having a wall thickness of 0.045 inches. On the high pressure side of the refrigeration cycle of the flake freezing system are a Scotsman condenser, Model 18-8763-01; an AC&R receiver, Model S-8065; and a Sporlan thermostatic expansion valve, Model EGS-1-C; as well as the heat exchanger listed above. These high pressure side components are connected in fluid communication by a ⅜ inch diameter copper pipe having a wall thickness of 0.032 inches. A Banner controller, Model CM5RB, is used for automatic operation of the flake freezing system.

In view of the description above, it is evident that the present invention provides an evaporator that is durable and efficient, yet relatively inexpensive to manufacture, as well as a flake freezing machine and system incorporating the same.

Although reference has been made to particular dimensions, materials of construction, and operating parameters for the purpose of explanation, it is understood that alternatives are available. It also will be apparent to those skilled in the art that various modifications and variations can be made in the design and construction of the flake freezing machine and system without departing from the scope or spirit of the invention.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A flake freezing machine for freezing flakes using a freezable liquid from a liquid source, the flake freezing machine comprising:

an evaporator including a cylindrical structure of cast construction having an inner surface and an outer surface, the inner surface defining an interior chamber, and a tubing assembly embedded inside the cylindrical structure between the inner surface and the outer surface, the tubing assembly including a tubular pipe wound in a helical configuration having an inlet for introducing a refrigerating fluid into the tubing assembly and an outlet for discharging the refrigerating fluid from the tubing assembly after the refrigerating fluid has circulated therethrough to cool the inner surface of the cylindrical structure to a temperature sufficient to freeze the liquid;

a rotatable shaft positioned within the interior chamber, the rotatable shaft being aligned with a central axis of the interior chamber;

a drive mechanism for rotating the rotatable shaft;

a nozzle provided on the rotatable shaft and in fluid communication with the liquid source for discharging the liquid toward the inner surface of the cylindrical structure during rotation of the rotatable shaft such that the liquid freezes on the inner surface of the cylindrical structure as a frozen sheet when the refrigerating fluid is being circulated through the tubing assembly; and a blade member mounted on the rotatable shaft for removing the frozen sheet from the inner surface of the cylindrical structure in the form of frozen flakes.

2. The flake freezing machine of claim 1, wherein the cylindrical structure is formed of aluminum.

3. The flake freezing machine of claim 2, wherein the evaporator further includes a layer of chrome over at least the inner surface of the cylindrical structure.

4. The flake freezing machine of claim 1, wherein the tubing assembly is formed of stainless steel.

5. The flake freezing machine of claim 1 further including a liquid distribution pan positioned on the rotatable shaft and in fluid communication with the liquid source, the nozzle extending from liquid distribution pan for discharging the liquid therefrom.

6. The flake freezing machine of claim 5 further including a basin along a lower portion of the cylindrical structure for collecting the liquid from the inner surface of the cylindrical structure that does not freeze thereon.

7. The flake freezing machine of claim 6 further including a pump for recirculating the liquid from the basin into the liquid distribution pan.

8. The flake freezing machine of claim 1, wherein a plurality of nozzles are mounted on the rotatable shaft, each nozzle being in fluid communication with the liquid source.

9. The flake freezing machine of claim 1 further including a wiper member on the rotatable shaft in a position before the blade member relative to the rotation of the rotatable shaft, the wiper member removing excess liquid from the frozen sheet on the inner surface of cylindrical structure.

10. The flake freezing machine of claim 1, wherein the blade member includes at least one finger element for breaking the frozen sheet on the inner surface of the cylindrical structure into frozen flakes.

11. The flake freezing machine of claim 1, wherein the blade member includes a blade edge for shaving the frozen sheet on the inner surface of the cylindrical structure into frozen flakes.

12. The flake freezing machine of claim 1 further including a deflector shield positioned below the blade member for deflecting the frozen flakes that are removed from the inner surface of the cylindrical structure toward a central discharge opening.

13. The flake freezing machine of claim 1, further including insulating material positioned around the outer surface of the cylindrical structure.

14. The flake freezing machine of claim 1, further including insulation material positioned adjacent upper and lower surfaces of the cylindrical structure.

15. A flake freezing system for producing frozen flakes using a freezable liquid from a liquid source, the flake freezing system comprising:

a flake freezing machine including an evaporator including a cylindrical structure having an inner surface and an outer surface such that the inner surface defines an interior chamber, and a tubing assembly located inside the cylindrical structure between the inner surface and the outer surface, the tubing assembly including an inlet for introducing a refrigerating fluid into the tubing assembly and an outlet for discharging the refrigerating fluid from the tubing assembly after the refrigerating fluid has circulated therethrough to cool the inner surface of the cylindrical structure to a temperature sufficient to freeze the liquid, a rotatable shaft positioned within the interior chamber, the rotatable shaft being aligned with a central axis of the interior chamber, a drive mechanism for rotating the rotatable shaft, a nozzle provided on the rotatable shaft and in fluid communication with the liquid source for discharging the liquid toward the inner surface of the cylindrical structure during rotation of the rotatable shaft such that the liquid freezes on the inner surface of the cylindrical structure as a frozen sheet when the refrigerating fluid is being circulated through the tubing assembly, and a blade member mounted on the rotatable shaft for removing the frozen sheet from the inner surface of the cylindrical structure in the form of frozen flakes;

an accumulator in fluid communication with the outlet of the tubing assembly to accumulate the refrigerating fluid from the tubing assembly after circulating therethrough;

a compressor in fluid communication with the accumulator to pressurize the refrigerating fluid from the accumulator;

a condenser in fluid communication with the compressor to condense the pressurized refrigerating fluid from the compressor; and a heat exchanger in fluid communication with the condenser and the inlet of the tubing assembly of the evaporator, the heat exchanger further being in fluid communication with the accumulator for pre-cooling the condensed refrigerating fluid from the condenser prior to being introduced into the inlet of the tubing assembly by using the refrigerating fluid from the accumulator.

16. The flake freezing system of claim 15 further including a pump in fluid communication with the liquid source to provide the liquid to the nozzle for discharge onto the inner surface of the cylindrical structure.

17. The flake freezing system of claim 16 further including a controller in electrical communication with at least one of the drive mechanism of the flake freezing machine, the pump and the compressor to control operation of the flake freezing system automatically.

18. The flake freezing system of claim 17 further including a sensor to determine when a sufficient amount of frozen flakes has been produced, and further wherein the controller is in communication with the sensor to deactivate the flake freezing system when the sufficient amount of frozen flakes is produced.

19. The flake freezing system of claim 15, wherein the cylindrical structure of the evaporator is a cast construction and the tubing assembly includes a tubular pipe that is wound in a helical configuration and embedded in the cylindrical structure between the inner surface and an outer surface.

20. A flake freezing machine for freezing flakes using a freezable liquid from a liquid source, the flake freezing machine comprising:

an evaporator including a cylindrical structure of cast construction having an inner surface and an outer surface, the inner surface defining an interior chamber and having layer of chrome provided thereover, and a tubing assembly embedded inside the cylindrical structure between the inner surface and the outer surface, the tubing assembly including a tubular pipe wound in a helical configuration having an inlet for introducing a refrigerating fluid into the tubing assembly and an outlet for discharging the refrigerating fluid from the tubing assembly after the refrigerating fluid has circulated therethrough to cool the inner surface of the cylindrical structure to a temperature sufficient to freeze the liquid;

a rotatable shaft positioned within the interior chamber, the rotatable shaft being aligned with a central axis of the interior chamber;

a drive mechanism for rotating the rotatable shaft;

a nozzle provided on the rotatable shaft and in fluid communication with the liquid source for discharging the liquid toward the inner surface of the cylindrical structure during rotation of the rotatable shaft such that the liquid freezes on the inner surface of the cylindrical structure as a frozen sheet when the refrigerating fluid is being circulated through the tubing assembly; and a blade member mounted on the rotatable shaft for removing the frozen sheet from the inner surface of the cylindrical structure in the form of frozen flakes.

* * * * *